US007530762B2

(12) United States Patent
Reed et al.

(10) Patent No.: US 7,530,762 B2
(45) Date of Patent: May 12, 2009

(54) METHODS AND APPARATUSES FOR SURFACE FINISHING CURED CONCRETE

(76) Inventors: Johnny Reed, 109 Foxcroft Way, Anderson, SC (US) 29621; Paul Copoulos, 7856 Fielder Rd., Jonesboro, GA (US) 30236

( * ) Notice: Subject to any disclaimer, the term of this patent is extended or adjusted under 35 U.S.C. 154(b) by 0 days.

(21) Appl. No.: 11/804,911

(22) Filed: May 21, 2007

(65) Prior Publication Data

US 2007/0292207 A1 Dec. 20, 2007

Related U.S. Application Data

(60) Provisional application No. 60/808,879, filed on May 26, 2006.

(51) Int. Cl.
*E01C 19/22* (2006.01)

(52) U.S. Cl. ..... 404/112; 404/94; 451/350

(58) Field of Classification Search ..... 404/93, 404/94, 112; 451/351, 353, 350
See application file for complete search history.

(56) References Cited

U.S. PATENT DOCUMENTS

| | | | | |
|---|---|---|---|---|
| 3,098,329 | A * | 7/1963 | Doran | 451/353 |
| 3,683,761 | A * | 8/1972 | Babic | 404/112 |
| 3,934,377 | A | 1/1976 | Tertinek | 51/177 |
| 3,936,212 | A | 2/1976 | Holz, Sr. et al. | 404/112 |
| 4,155,596 | A | 5/1979 | Brejcha | 299/40 |
| 4,317,314 | A | 3/1982 | Carlstrom et al. | 51/177 |
| 4,742,652 | A | 5/1988 | Cannan et al. | 51/177 |
| 5,085,008 | A * | 2/1992 | Jennings et al. | 451/184 |
| 5,454,751 | A | 10/1995 | Wiand | 451/526 |
| 5,567,503 | A | 10/1996 | Sexton et al. | 428/143 |
| 5,605,493 | A * | 2/1997 | Donatelli et al. | 451/41 |
| 5,762,545 | A * | 6/1998 | Edwards | 451/359 |
| 5,816,739 | A | 10/1998 | Allen | 404/112 |
| 5,890,833 | A | 4/1999 | Allen et al. | 404/112 |
| 6,058,922 | A | 5/2000 | Sexton | 125/13.01 |
| 6,299,522 | B1 * | 10/2001 | Lee | 451/548 |
| 6,475,067 | B1 | 11/2002 | Jones et al. | 451/41 |
| RE38,364 | E | 12/2003 | Wetherell et al. | 451/28 |
| 7,018,132 | B2 | 3/2006 | Ewer et al. | 404/112 |
| 2002/0115396 | A1 * | 8/2002 | Sarantitis | 451/350 |
| 2005/0172428 | A1 * | 8/2005 | Thysell | 15/4 |
| 2005/0175782 | A1 * | 8/2005 | Graf | 427/393.6 |
| 2006/0025059 | A1 * | 2/2006 | Gueorguiev et al. | 451/350 |
| 2006/0034663 | A1 | 2/2006 | Lampley et al. | 405/75 |
| 2006/0183334 | A1 * | 8/2006 | Uhlenbrock et al. | 438/692 |

* cited by examiner

*Primary Examiner*—Raymond W Addie
(74) *Attorney, Agent, or Firm*—Willaimson Intellectual Property Law, LLC; Thomas R. Williamson, III

(57) ABSTRACT

A method and apparatus for finishing cured concrete floors using a riding trowel to which large diameter pans are attached having a balanced distribution of abraders releasably secured to the undersides of the pans. The individual abraders are preferably individually spring biased so as to maintain full contact with the floor when traversing undulations of the floor.

14 Claims, 10 Drawing Sheets

METHODS AND APPARATUSES FOR SURFACE FINISHING CURED CONCRETE

RELATED APPLICATION

Applicants claim the benefit of U.S. provisional patent application No. 60/808,879 filed May 26, 2006.

BACKGROUND OF THE INVENTION

Owners of facilities having large concrete floors want the floors to be flat, smooth and glossy. Defects or imperfections in a concrete floor surface are unacceptable to most business proprietors and therefore must be removed. Traditional methods used today to improve a concrete surface typically involve epoxy coating of the fully cured concrete surface, and buffing the concrete surface. Buffing techniques involve very little removal of concrete from the surface of fully cured concrete and therefore imperfections may remain. Grinding of the surface has been employed, however, current practices do not adequately removing certain defects, such as a shoe imprints in the concrete surface, do not produce as flat a surface as the owner may want, can not be made as flat as desired due to exposing aggregate and take too much time, which is almost always a negative from the owner's viewpoint. Currently concrete finishers use multiple small disks affixed to each of the blades at the base of a troweling machine; the machine applying power causing the blades to rotate with the abrasive surface of the disks in contact with the concrete surface. The weight of the machine acting directly upon the grinding disks is used for the application of the downward force acting on the disks. However, even this prior practice does not achieve the desired smooth glossy finish. Application of a water based surface hardener chemical, such as Diamond Hard marketed by Euclid Chemical Company, followed by polishing with a polishing machine, such as a Tenant polishing machine, has been employed on poured concrete surfaces after the concrete has been allowed to fully cure for 28 days. This last mentioned procedure does produce a somewhat shiny surface but not the degree of gloss desired by the owners of the facilities and it does not remove surface defects or blemishes such as battery acid spills, oil and the like or surface irregularities such as foot prints which may have been pressed into the surface before the concrete had completely cured, and which, if not removed, will adversely affect the surface appearance even though polished.

BRIEF SUMMARY OF THE INVENTION

The herein disclosed new apparatus technology plus new methods of using this technology includes smoothing a cured concrete floor using a large number of relatively small resiliently biased abraders mounted on a large rotating pan to remove imperfection in the surface without removing an excessive amount of surface material, thereby avoiding contact with large aggregate. By using the herein disclosed flattening and polishing method and apparatus with and without a surface hardener, a surface finish and shine is produced which resembles an automotive painted surface or polished ceramic tile. Achieving such an improved surface finish is accomplished through use of a very large diameter rotating pan having abrasive surface abraders which serve to flatten and polish a hardened concrete floor. A very large diameter pan can be releasably connected to each set of blades of a riding trowel or connected directly to each of its vertical trowel drive shafts.

Customers having merchandise establishments want the surface of their concrete floors to be level, smooth and polished. The riding trowel is typically used to smooth partially cured large concrete floors. Such machines force course aggregate about on eighth of an inch below the surface of the uncured concrete. The herein disclosed method and apparatus abrades the surface without exposing course aggregate and polishes the surface of cured concrete to produce a satin shiny finish.

BRIEF DESCRIPTION OF THE DRAWINGS

The accompanying drawings illustrate apparatus pertinent to the invention.

DETAILED DESCRIPTION OF THE INVENTION

Figure 1:
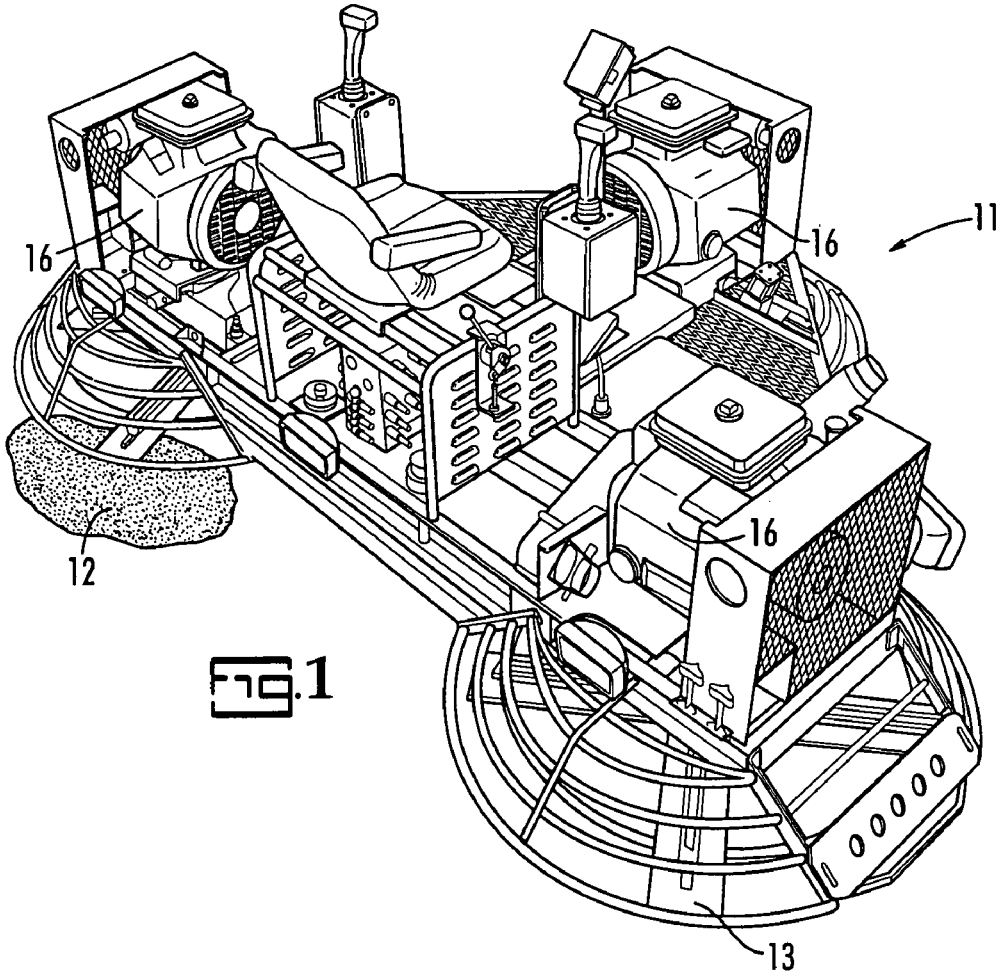
FIG. 1 is a perspective view of a riding trowel.
Figure 2:
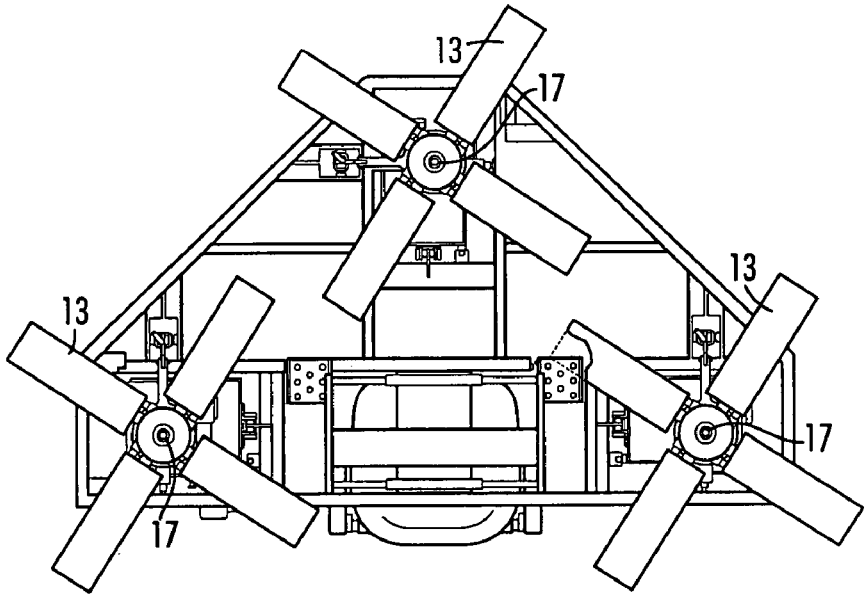
FIG. 2 is a bottom view of the riding trowel of FIG. 1.
Figure 3:
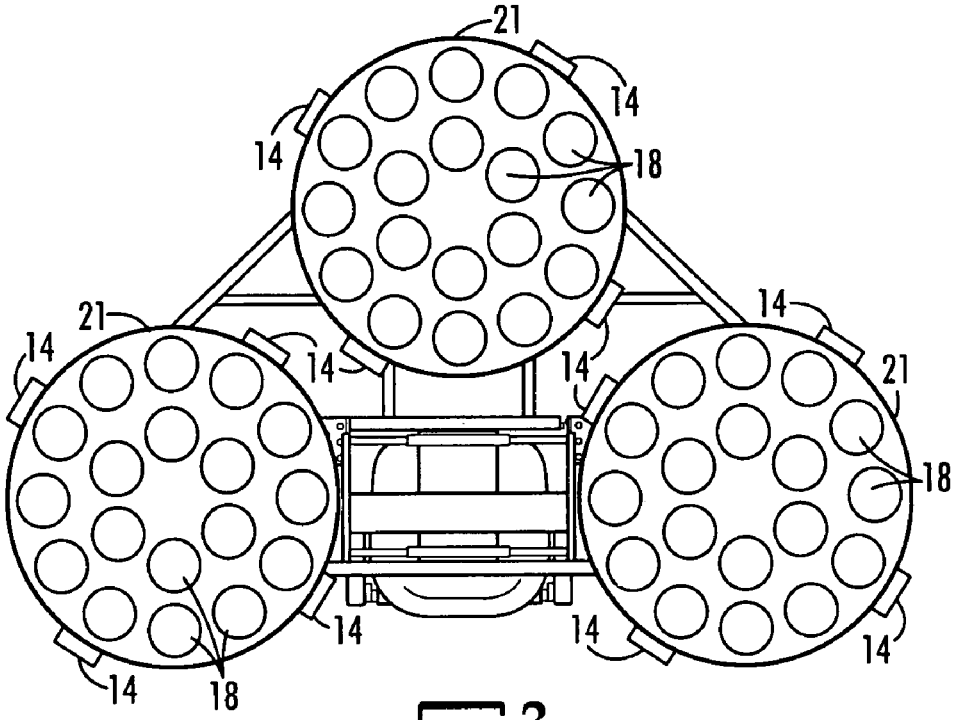
FIG. 3 is a bottom view of the riding trowel of FIGS. 1 and 2 having a large diameter pan releasably attached to the blades of each rotating trowel, which each pan having a plurality of small annular abrading discs.
Figure 4:
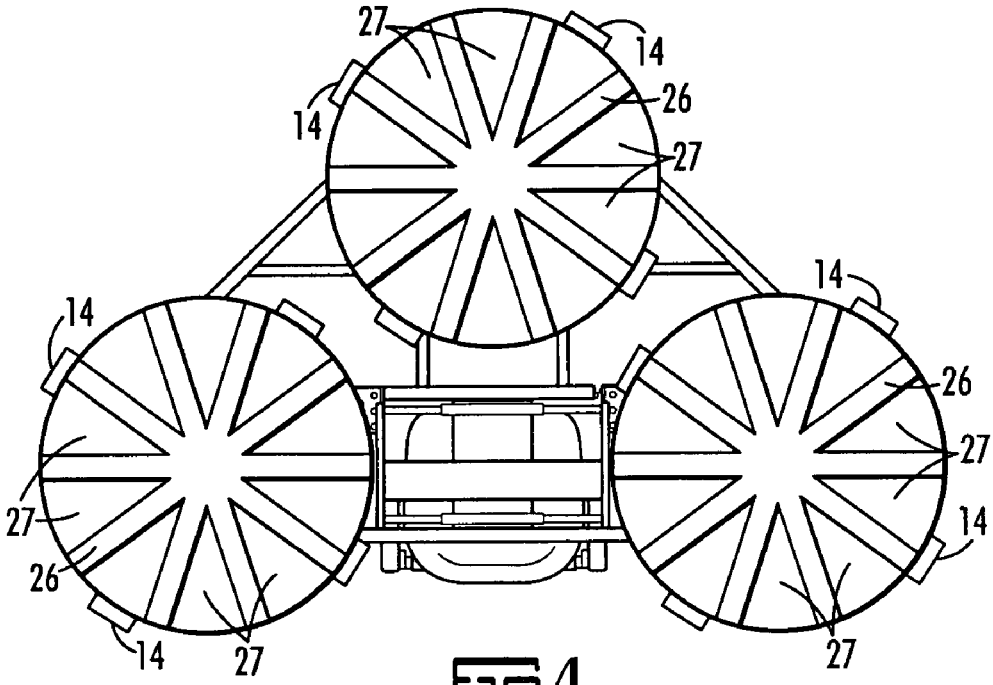
FIG. 4 is a bottom view similar to FIG. 3 but with pie shaped abrading pads attached to the three large diameter pans.

FIGS. 1 and 2 illustrate a riding trowel 11 used in smoothing concrete 12 which has not hardened. FIG. 2 is a bottom view of the riding trowel 11 showing three trowels 13 each having four blades 14. The trowels 13 are driven by three internal combustion engines 16 through vertical shafts 17, respectively. FIG. 3 shows three large pans 21 releasably secured to the blades 14 of the respective trowels 13 by suitable releasable fastening apparatus, not shown. Each pan 21 includes a relatively large number of relatively small diameter annular abraders 18, each of which is releasably fastened to the bottom of the pan 21 by a VELCRO fastener. FIG. 4 shows three large diameter pans 26 releasably secured to the trowel blades 14; the pans having large pie shaped abraders 27 releasably secured to their respective pans 26 by VELCRO fasteners. VELCRO material covers the entire bottoms of the pans 21, 26 and the mating bottoms of the abraders 18, 27.

Figure 5:
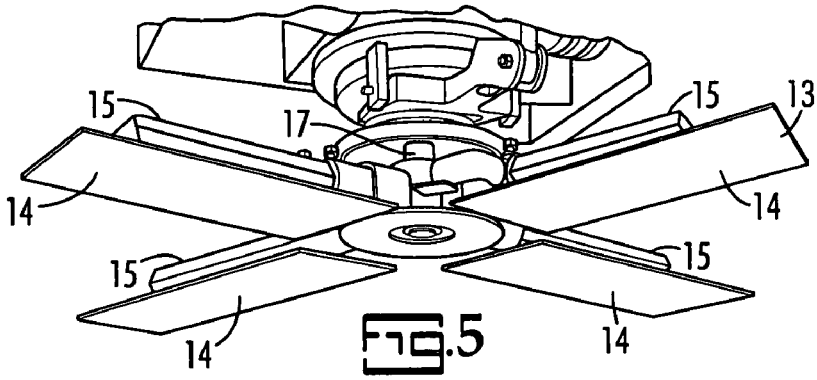
FIG. 5, in a bottom perspective view of one of the three rotatable trowels of the riding trowel shown in FIG. 1.
Figure 6:
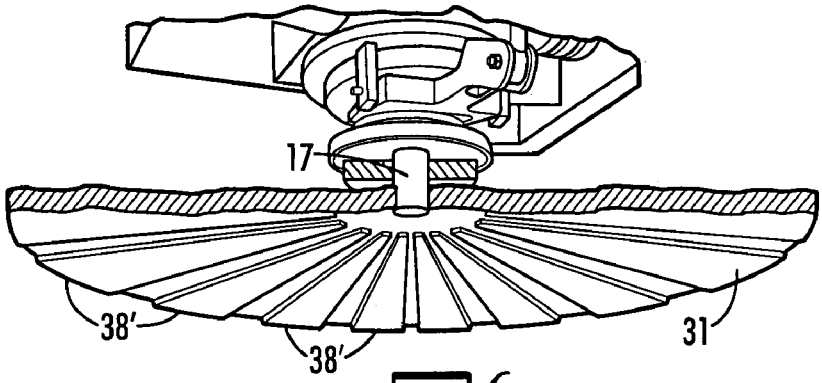
FIG. 6 is a perspective view similar to FIG. 5 but showing a large diameter abrading pan with parts broken away to show its attachment to the trowel drive shaft in place of the four bladed trowel.

FIG. 5 shows a four bladed trowel 13 secured to its vertical drive shaft 17. Each blade 14 is secured to one of the four radially extending support arms 15. FIG. 6 shows a large abrading diameter pan 31 secured for rotation with the drive shaft 17 in place of the trowel 13.

Figure 6A:
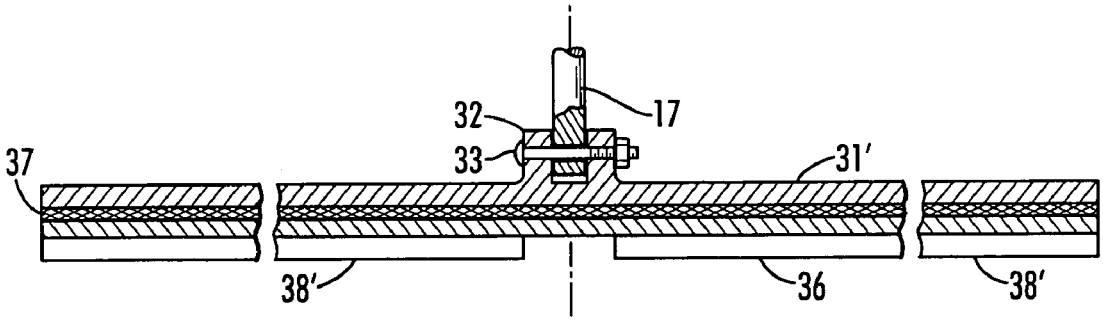
FIG. 6A is a vertical section of the abrading pan of FIG. 6 and its connection to the trowel drive shaft.

FIG. 6A is a vertical section showing an alternate construction with a center hub 32 of a pan 31' secured to the shaft 17 by a bolt 33. A single piece abrading disk 36 is secured to the underside of a pan 31' by VELCRO fastening material 37. The abrading disk 36 includes a plurality of pie shaped abraders 38' molded into the surface of the abrading disk 36.

Figure 7:
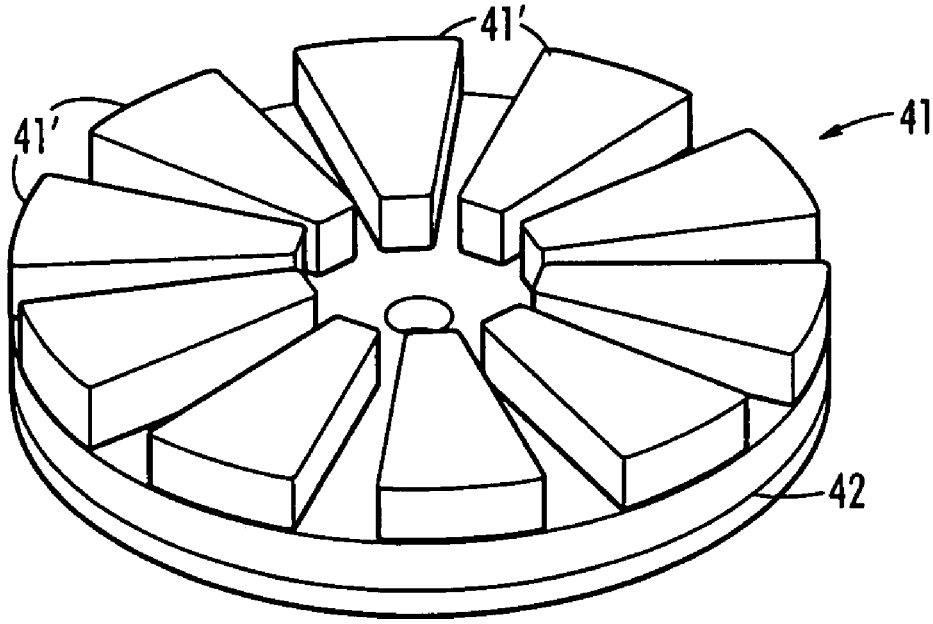
FIG. 7 is a perspective view of a first abrading disk.
Figure 8:
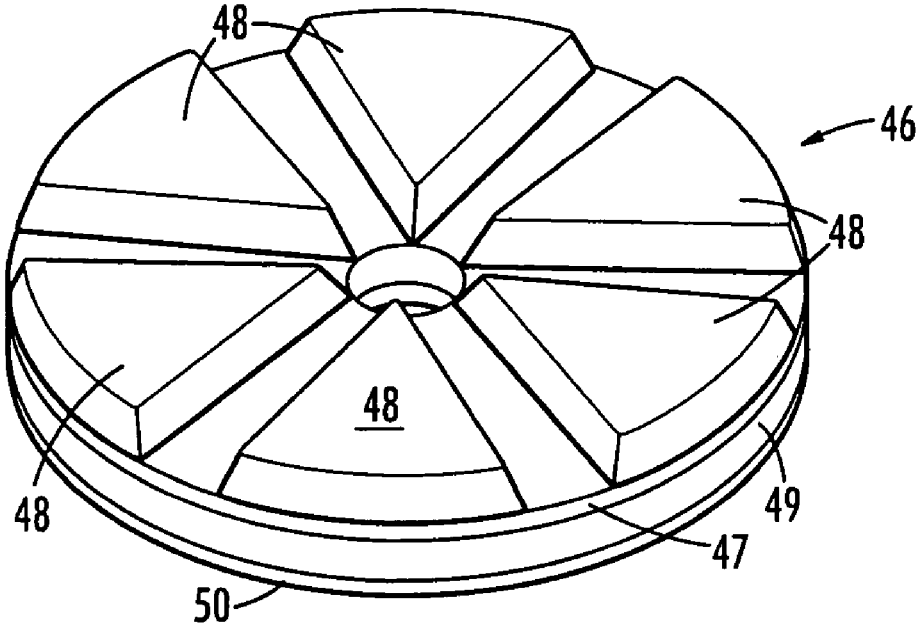
FIG. 8 is a perspective view of a second abrading disk which has abrasives embedded in plastic to provide a consistent abrading surface as the plastic material wears during use.
Figure 9:
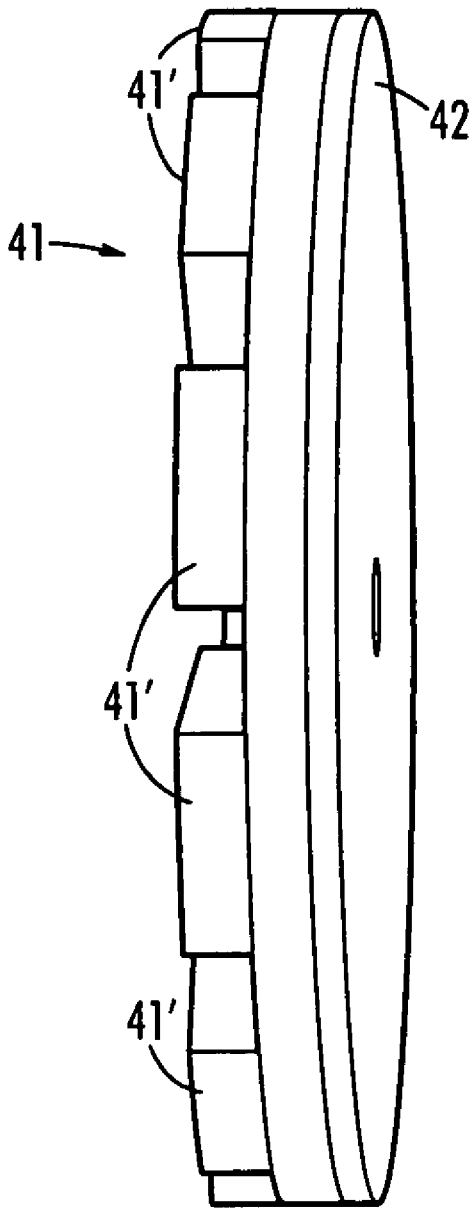
FIG. 9 is a side view of the abrading disk of FIG. 7 showing VELCRO material on its back side.
Figure 10:
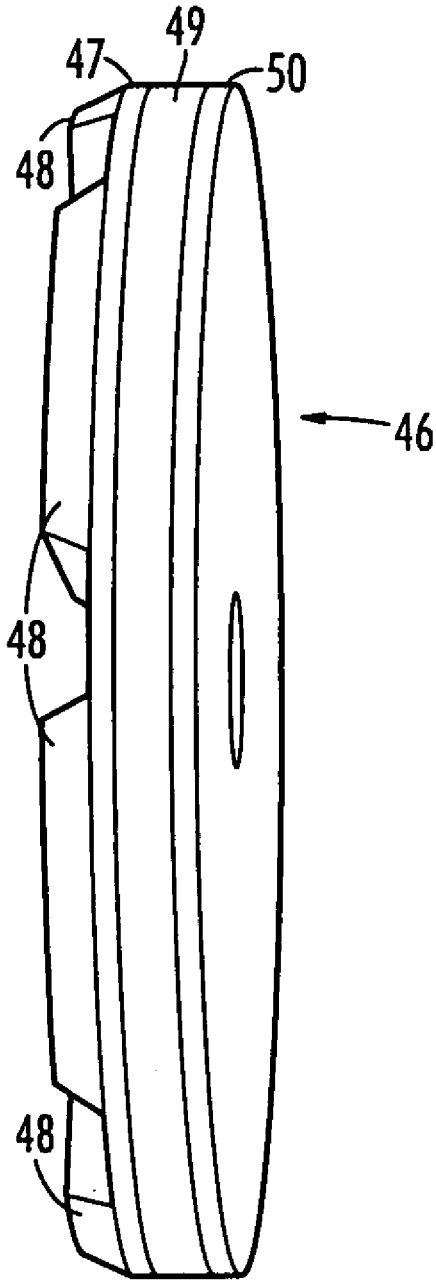
FIG. 10 is a side view of the abrading disk of FIG. 8 showing VELCRO material on its back side.

FIGS. 7 and 9 show a commercially available four inch diameter carbon steel abrading disk 41 having a plurality of circumferentially spaced pie shaped metal abraders 41' with embedded abrading material together with a VELCRO backing 42. FIGS. 8 and 10 show a commercially available 4 inch diameter plastic abrading disk 46 which has embedded grit, not shown, and which includes a plastic annulus 47 having six pie shaped abraders 48. The plastic annulus 47 is rigidly adhered to an annular backing plate 49 and an annular shaped layer of VELCRO material 50 is adhered to the plate 49. These commercially available abraders are designed for attachment to floor polishers to smooth concrete floors; however, the very flat and highly polished surface finish desired by owners of large floor areas, such as found in warehouse type retail stores, can not be achieved using a floor polisher with these small diameter prior art abrading devices.

Figure 11:
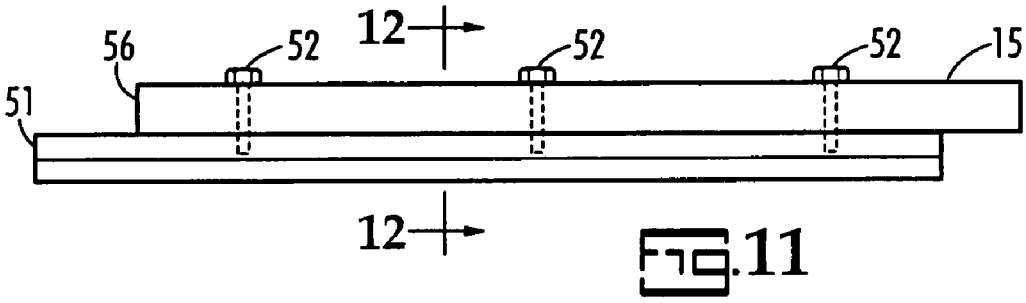
FIG. 11 is a partial side view showing attachment of a plastic blade with embedded abrasing particles connected to a trowel support arm of a riding trowel.
Figure 12:
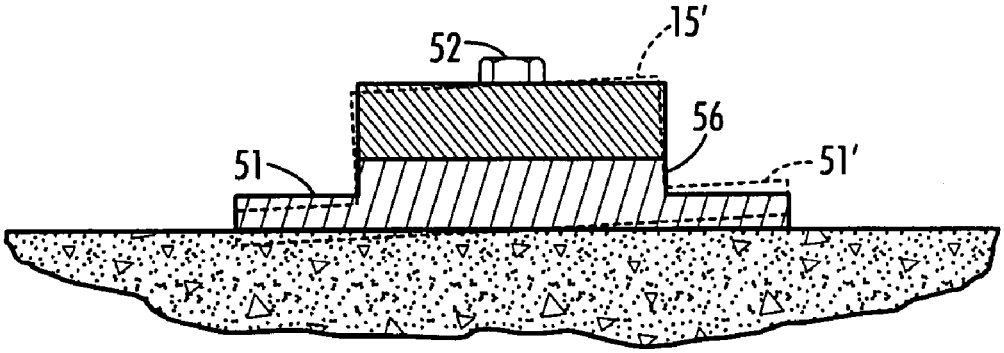
FIG. 12 is a section taken on line 12-12 in FIG. 11.

FIGS. 11 and 12 shows an alternate construction which has been found suitable for polishing concrete floors to a polished finish without exposing course aggregate even though the floor may not be perfectly level. In this alternative construction a plastic polishing blade 51 with embedded diamond dust, or other abrasive, is releasably secured by cap screws 52 to each of the trowel support arms 15 of the riding trowel 11, after the trowel blades 14 have been removed. The polishing blade 51 has a central raised ridge 56 which adds a vertical dimension for the fastening cap screws 52 so they will not engage the floor being polished as the blade 51 wears during use. The plastic blade is resilient; but is sufficiently stiff to ensure bottom surface abrading engagement. The riding trowel is equipped with control apparatus operable to tilt the arms 15 to which the trowel blades are normally secured. Thus the polishing blade 51 can be tilted to a tilted position indicated by broken lines 51' when the arm 15 is titled to its tilted position 15'. The blade 51 is preferably made of a molded plastic material with diamond dust added to the plastic molding compound so that a maximum amount of the surface and thickness of the blade can be used as it wears in use under a range of downward pressure from 1.40 to 2.50 pounds per square inch. The raised section or ridge 56 of the novel molded plastic blade 51 is about 1 to 3 inches wide, and about ¼ to ½ inches thick allowing the screws 52 to attach the blade 51 to the trowel arm 15 extending from the shaft 17 without extending into the portion of the blade 51 that wears away during the expected life of the blade 51.

Figure 13:
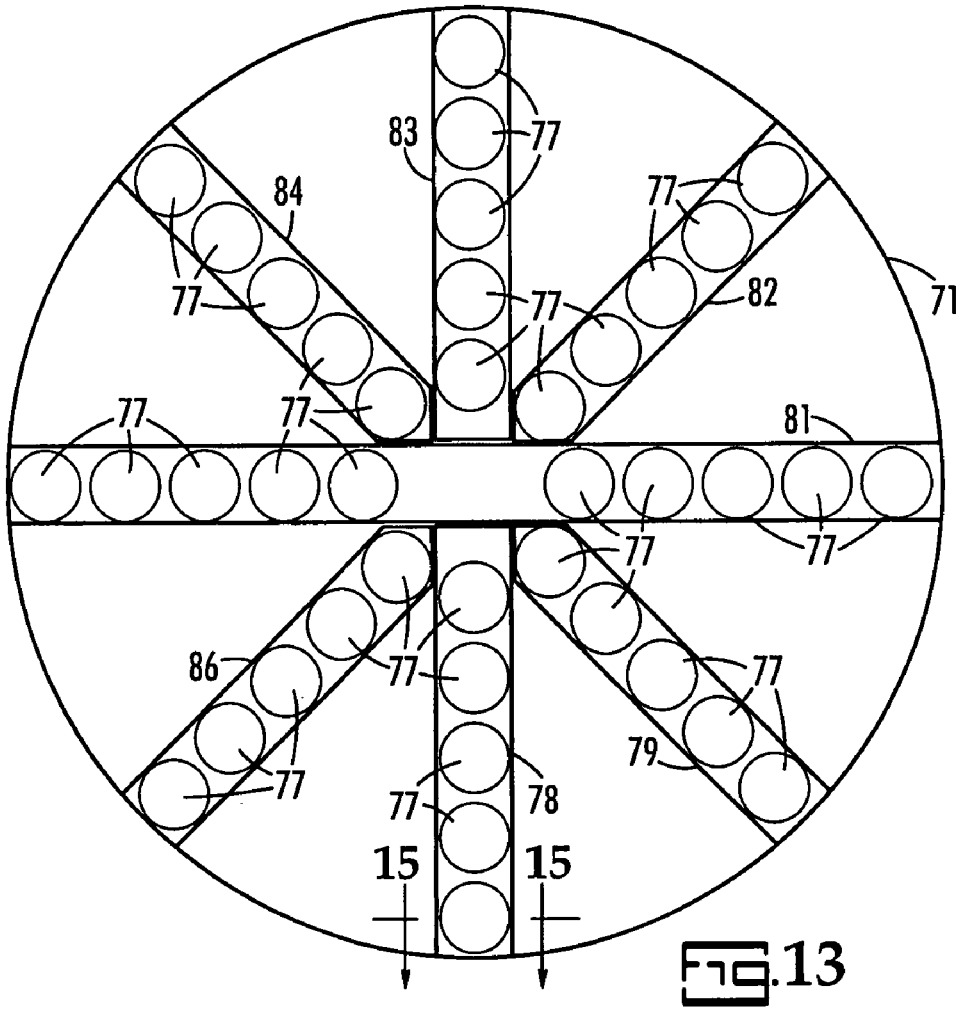
FIG. 13 is a bottom view of a pan showing relatively small round abraders secured to strips on the underside of the pan.
Figure 14:
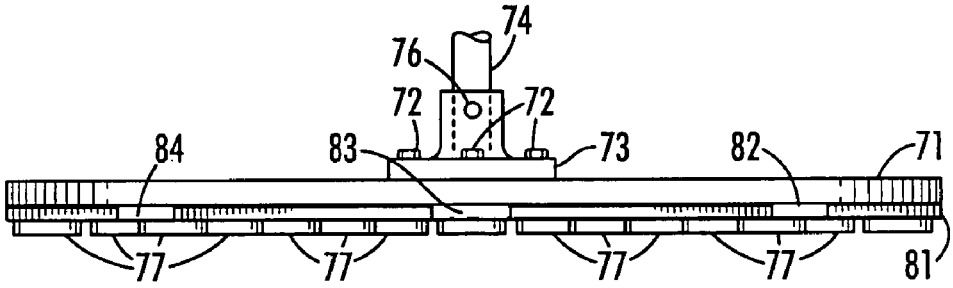
FIG. 14 is a side view of the pan showing its attachment to a riding trowel output shaft.
Figure 15:
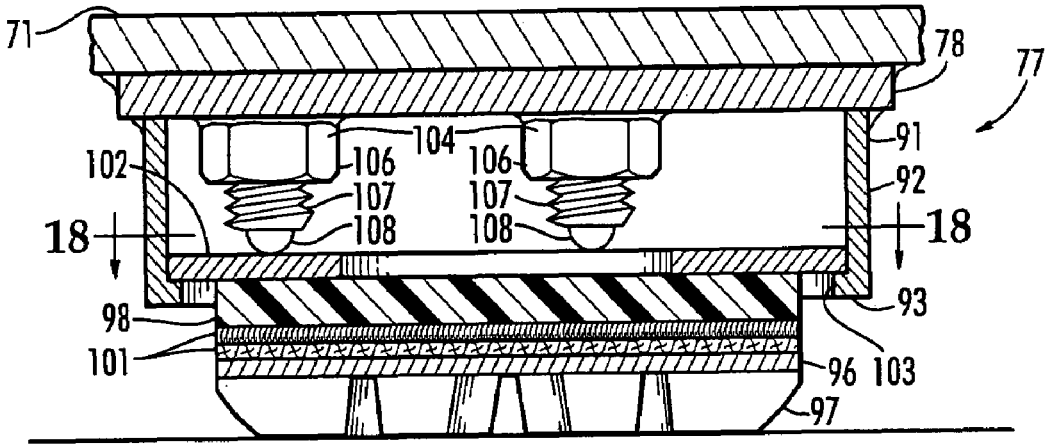
FIG. 15 is a section taken on line 15-15 in FIG. 13 showing details of an abrader engaging a level segment of a concrete floor.

Referring to FIGS. 13 and 14, a flat rigid annular pan 71 is secured by cap screws 72 to a hub 73 which in turn is secured to a shaft 74 of a riding trowel by a pin 76. A plurality of discs or abraders 77 are mounted to rigid flat metal stripes 78, 79, 81, 82, 83, 84, 86 welded to the bottom of the pan 71. The construction detail of the abraders 77 is shown in FIGS. 15-18. Each abrader 77 includes an annular housing 91 having a vertically extending cylindrical wall 92 and a horizontal flange 93 rigidly connected to and extending radially inward from the lower end of the cylindrical wall 92. The upper end of the cylindrical wall 92 is shown welded to the strip 78 which in turn is welded to the pan 71. Each abrader 77 is provided with a resiliently biased abrader assembly 96 which includes a synthetic annular pad 97 with embedded diamonds, a flat annulus 98, a Velcro fastener 101 and a back up plate or washer 102. The pad 97 is releasably connected to the flat annulus 98 of hard synthetic material by the Velcro fastener 101 and the annulus 98 is glued to the metal back up plate or washer 102 whose outer diameter is larger than the diameter of the annular opening 103 defined by the flange 93. Each abrader assembly 96 is resiliently biased downwardly by three thrust transmitting units 104 of each abrader 77; the thrust transmitting unit being illustrated in FIG. 17. The thrust transmitting unit 104 includes an internally threaded nut 106, an externally threaded cylinder 107 having a closed end threadly engaged in the nut 106, a hard plastic plunger 108 and a biasing coil spring 109 between the upper end of the plunger 108 and the flat horizontal end surface 111 of a cylindrically shaped internal cavity 112 of the threaded cylinder 107. The open or lower end 113 of the cylinder 107 is crimped radially inward forming a radially inward extending ledge 114 against which a radially outward extending shoulder 116 of the plunger 108 rests under the biasing influence of the coil spring 109. Upon the threaded cylinder 107 being threaded into the nut 106 a predetermined extent, it is welded to the nut 106. Three thrust transmitting units 104 are equally spaced circumferentially from one another have their nuts 106 welded to the strip 78 and subsequently the upper end of the annular housing 91 is welded to the strip 78.

Figure 16:
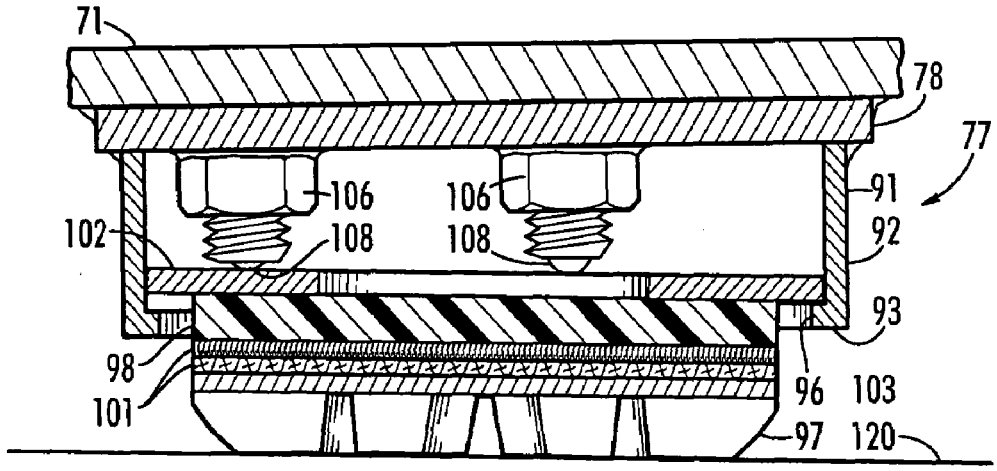
FIG. 16 is a section view similar to FIG. 15 showing a tilted position of the abrader assembly caused by a surface deviation in the concrete floor.
Figure 17:
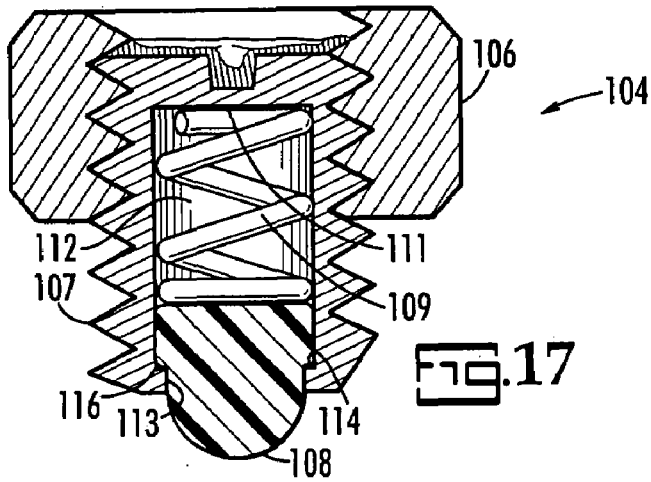
FIG. 17 is a vertical section through one of the three thrust transmitting units in each abrader.
Figure 18:
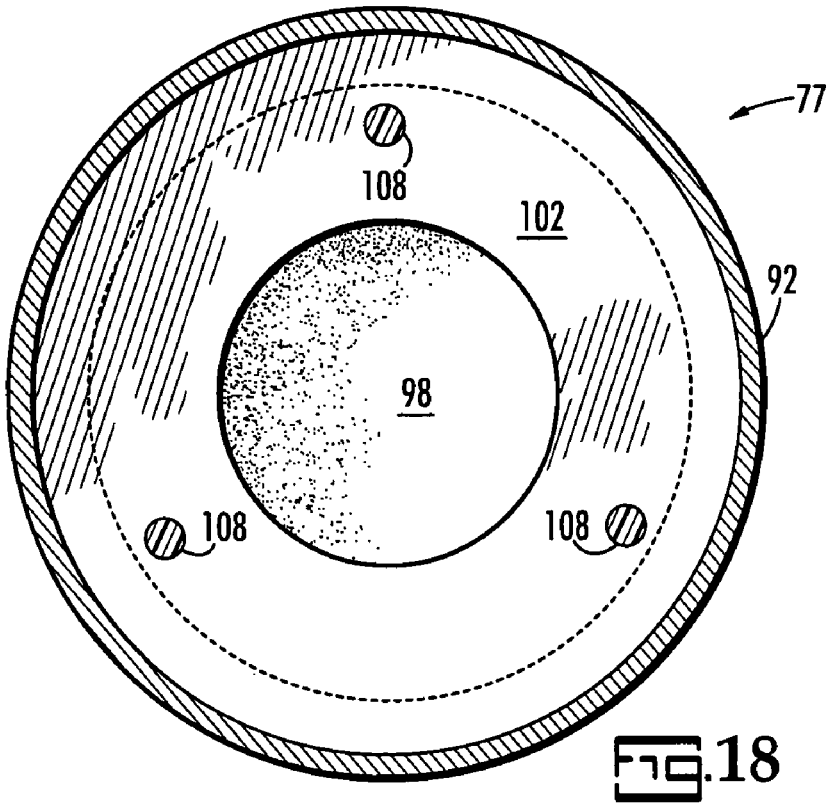
FIG. 18 is a section taken on line 18-18 in FIG. 15.

FIG. 18 shows the three circumferentially spaced plungers 108 bearing downwardly against the plate 102. The weight of the riding trowel 11 acts to cause the plunger 108 to depress a distance into the screw such that the plunger is free to move up or down in response to changes in surface slope. During a concrete finishing operation using the herein discloses method and apparatus, the resiliently biased assemblies 96 maintain the bottom surface of their pads 97 in contact with the concrete surface even though there are some undulations in the concrete surface. Since the pads 97 of the assemblies 96 are biased independently of one another they are able to maintain contact with the floor surface through the minor deviations encountered in concrete floor surfacing operations. Additionally, the three spring loaded thrust transmitting units 104 allow independent tilting of the pads 97, thereby further insuring polishing contact with floor areas having small undulations or other surface irregularities. FIG. 16 shows the abrader 77 traversing a deviation in a concrete floor surface 120. The plunger 108 at the left side of FIG. 16 has been depressed into the screw a greater extent than the plunger on the right side because of the change in surface slope in the deviation. Thus the area of the deviation is effectively abraded to remove surface imperfection and also polished using sets of finer grit abrading pads after application of a surface hardening chemical.

Figure 19:
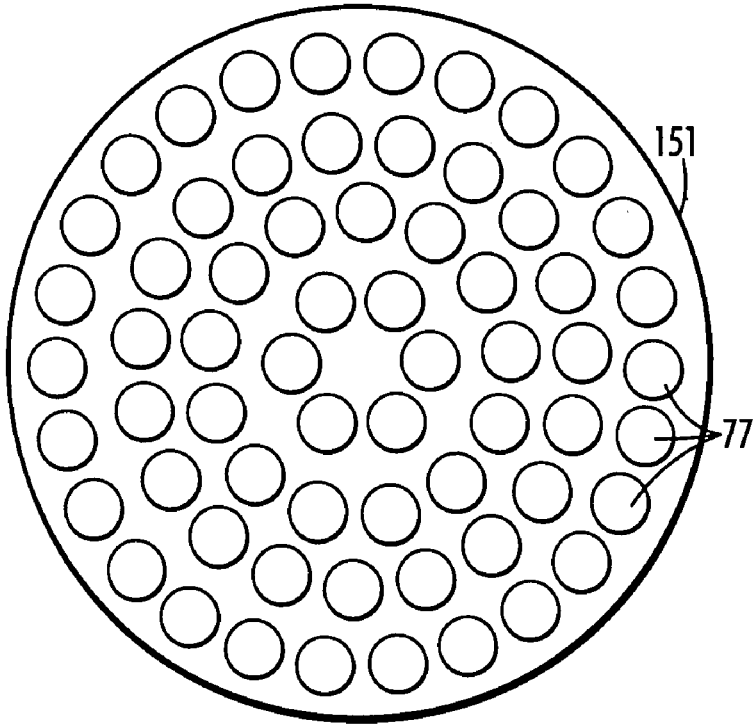
FIG. 19 is a bottom view of a pan with plurality of abraders.

FIG. 19 shows an alternate construction in which a pan 151 has a plurality of assemblies 77 welded to its underside without the intermediate strips 78, 79, 81, 82, 83, 84, 86 shown in FIGS. 13 and 14. The abraders 77 are circumferentially spaced at uniformly spaced intervals; their positions defining concentric circles.

Figure 20:
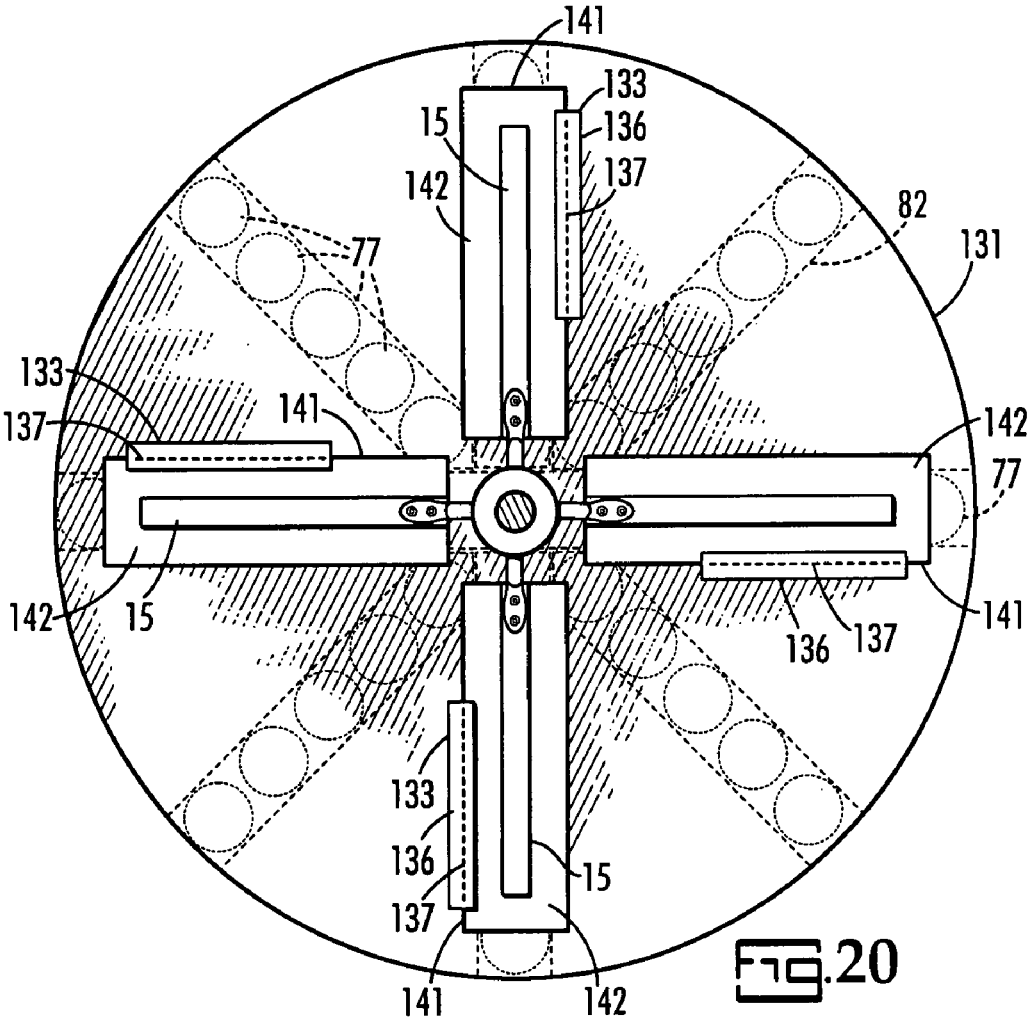
FIG. 20 is a top view of a pan showing trowel support arms lowered for connection with channel members on the back side of a pan.
Figure 21:
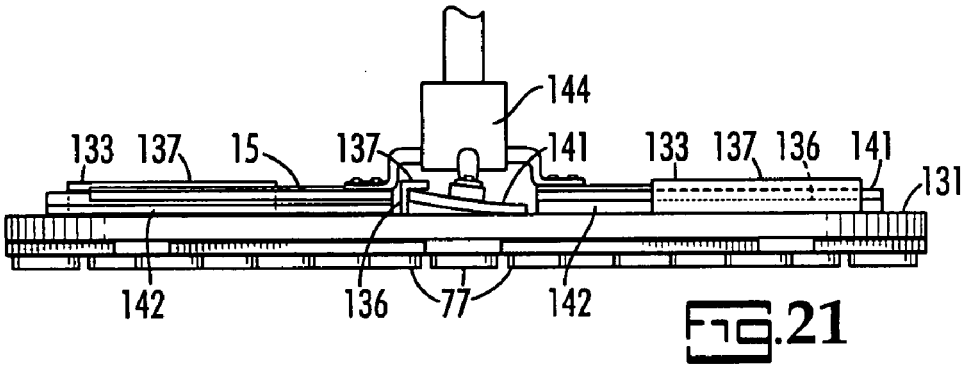
FIG. 21 is a side view of the pan and support arms shown in FIG. 20.

Referring to FIGS. 20 and 21, a pan 131, with a set of abrader assemblies 77 secured to its underside, includes four radially extending angle shaped connectors 133 rigidly secured to its top side. The lower end of the vertical flange 136 of each connector 133 is welded to the top side of the metal pan 131 in a radial position for engagement by the leading edges 141 of the trowel blades 142 when the blade module 144 is lowered onto the top of the pan 131 and then rotated clockwise as viewed in FIG. 20. The horizontally disposed flanges 137 of the angle shaped connectors 133 prevent vertical separation of the pan 131 from the blades 142 of the riding trowel.

The desired surface flatness and high glossy finish are achieved by using large diameter pans to which sets of abrading disks are releasable attached in balanced distribution, such as shown in FIGS. 3, 4, 6, 13, 19, 20 and 21. These large diameter abrading tools require application of an appreciable amount of downward force to remove the optimum amount of surface concrete and to achieve the desired flatness. The riding trowel has been found to be a suitable type machine to which such large diameter pans, or large diameter grinding/polishing disks can be secured either to the trowel blades as shown in FIGS. 3, 4, 20 and 21 or to the trowel blade drive shafts as shown in FIGS. 6, 6A and 14. The use of large diameter pans with a plurality of abraders, and substantially equal weight distribution on the abrading surfaces contributes to forming a finished surface on fully cured concrete which is very flat and highly polished with a compressive strength between 3000 and 6000 pounds per square inch. Suitable riding trowels are currently manufactured by several companies including Whiteman Company and Allen Company. Using a 60 inch diameter pans presenting abrading surfaces covering one half their underside areas, it has been found that between 2000 and 3500 pounds of weight needs to be applied to each pan, which translates to between 1.40 and 2.50 pounds per square inch of downward force being applied to the concrete surface by the abrading surfaces.

After the concrete floor has been poured, troweled and hardened, the finishing process begins in which progressively finer grit floor finishes are developed. The floor is abraded and polished in sequential steps using sets of abraders having progressively finer grit. The sequence of flattening and polishing the concrete is critical to achieving the desired degree of surface smoothness and high gloss. The sequence of steps in a preferred embodiment is to spray water on the floor and start with a set of abraders having a 50 grit diamond surface followed by one or more grinding passes using sets of abraders with progressively finer grits to about 400 grit. Water is preferably applied to the concrete surface prior to each flattening step and the floor is preferably vacuumed after abrading and prior to the next step. A standard liquid removal machine may be used to vacuum up the foreign material which typically includes water which is mixed with concrete dust and abrader particles as a result of the flattening step. The concrete surface is then allowed to dry.

Next a suitable liquid hardener such as the Diamond Hard marketed by Euclid Chemical may be applied, as by spraying, to the surface of the concrete. Excess liquid is removed, as by vacuum. The surface of the concrete is allowed to dry. The next polishing steps employ the large rotating circular pans with sets of abraders or a single large diameter abrader disk. The floor polishing is achieved by using sets of progressively finer grit abraders selected from the grit sizes between 400 and 3,500 grit. The floor surface is vacuumed after each step to remove liquid and powder. The liquid hardener makes the surface of the concrete very hard and durable. If a liquid chemical is not used, the above steps of using sets of abraders with progressively finer grits selected from between 400 and 3,500 must still be performed to achieve the desired degree of surface smoothness and gloss of the concrete surface. The end result is a very smooth and high gloss surface.

In the concrete finishing process, the total amount of concrete that will be removed from the original concrete surface will be less than ⅛ inch. The surface finish method does not grind into the aggregate which after troweling poured concrete is normally at least ⅛ inch below the floor surface. The purpose of the progressive increase in the grit number is to reduce the surface porosity of the concrete. If a chemical is used, it is applied following the grind using the first plurality of sets of 50 to 400 grit surfaced abraders in order for the chemical to be able to soak easily into the surface of the concrete. If the porosity of the concrete is too low, the chemical will not soak in properly.

One of the most significant benefits of this new technology is the ability to achieve a highly polished concrete surface. This is achieved by using relatively large diameter rotating pans with sets of abraders to which sufficient downward force is applied to remove surface defects, oil spots, battery acid, tire marks and the like. The pan may be 24 to 86 inches in diameter. Attaching the sets of abraders to the pan by VELCRO material makes it easy and less time consuming to progressive change the abraders during the sequential steps in finishing the floor. Also, excessively worn abraders can be replaced without replacing the pan. The VELCRO connection saves time in switching between sets of coarse abraders with diamond chips embedded in their surface for relatively coarse finishing and in switching between sets of abraders with embedded fine grit for high polish finishing.

A pan with flattening or polishing sets of abraders can be connected either to the trowel blades of each trowel or to one of the vertical trowel blade drive shafts of a riding trowel machine. The spring biased abrader assemblies 77 are particular advantageous in sequentially polishing the floor with the second plurality of sets of abraders having for instance 400, 800, 1,500 and 3,500 grit, respectively. However abrader pads of the first plurality of sets of abraders, with 4 to 400 grit can also be advantageously used in the spring biased abrader assemblies 77.

The steps to follow in practicing the inventive method on a concrete surface that has been allowed to fully cure for the full 28 days can be summarized as follows:

1. Spray or otherwise apply water to the surface of the fully cured concrete.
2. Using a riding toweling machine grind off a small thickness (less than ⅛") of the surface of the concrete in the following manner:
   a. Use a 24 to 86 inch diameter pan with sets of abraders from a first plurality of sets of abraders having a grit surface between 50 and 400 grit. The rpm of the pan should be between 150 and 200 and the downward thrust of the pan on the floor should be between 1.4 and 2.5 pounds per square inch.
   b. After abrading with each set, vacuum up the water and concrete powder that has been generated. Allow the surface to dry and then spray water on the concrete surface.
3. If a liquid hardening chemical is used, it is next applied as by spraying a measured amount onto the concrete surface. The chemical hardening solution should be allowed to penetrate into the pores of the concrete and to cure. If the hardening solution dries too quickly water is sprayed on the concrete surface to insure penetration of the chemical into the floor surface. After the chemically treated concrete has dried, spray water on the surface of the concrete. Then polish the concrete using a second plurality of sets of progressively finer grit surface abraders within the range of 400 to 3,500 grit using the riding trowel machine to which the correct amount of weight has been added to give the required amount of downward force. After each abrading step the concrete surface is vacuumed to remove foreign particles.

The embodiments shown in FIGS. 13-21 are advantageous in finishing and polishing newly laid concrete floors and in fully polishing older concrete floors from which surface material cannot be removed from high spots without exposing stone aggregate. The small individually biased abraders follow the floor contour to smooth and polish the floor surface without exposing stone aggregate. A smooth polished satin finish can be achieved on an old concrete floor similar to that achieved when using the same equipment in finishing freshly cured concrete, provided the floor surface is reasonably flat.

What is claimed is:

1. A concrete finishing apparatus comprising:

a riding trowel having a plurality of vertical power driven output shafts each rotatably driving a plurality of trowel blades, an annular pan releasably secured for coaxial rotation to each of said shafts, said pan being at least 24 inches in diameter and having a flat horizontal underside, a plurality of abraders connected to said underside of said pan, each of said abraders having a pad carrier and an abrading pad releasably secured to said pad carrier, said pad having a bottom abrading surface.

2. The concrete finishing apparatus of claim 1 wherein said abraders have a balanced distribution about said underside of said pan.

3. The concrete finishing apparatus of claim 2 wherein each of said abrading pads is releasably secured to its associated pad carrier by VELCRO fasteners.

4. The concrete finishing apparatus of claim 2 wherein said abraders are positioned in concentric circles.

5. The concrete finishing apparatus of claim 1 wherein said abraders includes a housing secured to said pan, said pad carrier being telescopically mounted on said housing for vertical movement relatively thereto and at least one vertically acting resilient thrust transmitting unit is operatively interposed between said housing and said pad carrier.

6. The concrete finishing apparatus of claim 5 wherein said abrading pad and said carrier move vertically and tilt in traversing undulations of a concrete surface.

7. The concrete finishing apparatus of claim 5 wherein three vertically acting resilient thrust transmitting units are interposed between said housing and said pad carrier.

8. The concrete finishing apparatus of claim 7 wherein said abrading pad is annular and said three thrust transmitting units are equally spaced circumferentially from one another to define a circle concentric with said annular abrading pad.

9. The concrete finishing apparatus of claim 1 wherein said diameter of said pan is between 24 and 86 inches.

10. A method of finishing a cured concrete floor to a highly polished condition, comprising the steps of:

providing a power driven riding trowel machine having a plurality of trowels, each of which is driven about a vertical axis by a vertically disposed output shaft, providing a 24 to 86 inch flat annular pan for each trowel which is adapted for releasable coaxial connection thereto so as to rotate therewith, said pan having an underside adapted to releasably connect to a plurality of abraders, providing a first plurality of sets of abraders adapted for releasable connection to said underside of said pans, said abraders of said first plurality of sets of abraders having progressively finer grit between 4 and 400, sequentially abrading said floor using said riding trowel machine with a pan releasably connected for rotation with each of its trowels and with said first plurality of sets of abraders releasably attached thereto, removing foreign material from said floor after each sequence of abrading with said first plurality of sets of abraders, applying a liquid hardener to said floor, providing a second plurality of sets of abraders having sequentially finer grit between 400 and 3,500, sequentially polishing said floor using said riding trowel machine with a pan releasably connected beneath and for rotation with each of its trowels and with said second plurality of sets of abraders releasable attached thereto, and removing foreign material from said floor after each sequence of abrading with said second plurality of sets of abraders.

11. The method of claim 10 wherein said first set of plurality of abraders includes abrading material with diamond chips embedded therein.

12. The method of claim 10 wherein said first plurality of sets of abraders includes four sets having 50, 100, 200 and 400 grit abraders, respectively.

13. The method of claim 12 wherein said second plurality of sets of abraders includes two sets having 800 to 1,500 grit abraders, respectively.

14. The method of claim 10 including applying water to said concrete floor prior to abrading with said first plurality of sets of abraders.

* * * * *